US005254225A

United States Patent [19]

Gallup

[11] Patent Number: 5,254,225

[45] Date of Patent: Oct. 19, 1993

[54] RECOVERY OF METALLIC COMPOUNDS FROM GEOTHERMAL BRINE

[75] Inventor: Darrell L. Gallup, Chino, Calif.

[73] Assignee: Union Oil Company of California, Los Angeles, Calif.

[21] Appl. No.: 752,048

[22] Filed: Aug. 29, 1991

[51] Int. Cl.[5] ..... C25C 1/00

[52] U.S. Cl. ..... 204/105 R; 204/150 M; 204/112; 204/114; 204/115; 204/149

[58] Field of Search ..... 204/105 R, 105 M, 112, 204/114, 115, 130, 149

[56] References Cited

U.S. PATENT DOCUMENTS 3,966,567 6/1976 Pace et al. ..... 204/105 R
4,619,744 10/1986 Horton ..... 204/105 R

OTHER PUBLICATIONS

"Recovery of Heavy Metals From High Salinity Geothermal Brine", NTIS Order No. PB81-222218, pp. 125-127, Dec. 1980, by Eldon P. Farley, El Lorraine Watson, Digby D. MacDonald, Robert W. Bartlett, and Gopola N. Krishnan.

*Primary Examiner*—John Niebling
*Assistant Examiner*—Patrick J. Igoe
*Attorney, Agent, or Firm*—Gregory F. Wirzbicki; Clark DeLarvin; Charles L. Hatman

[57] ABSTRACT

A geothermal brine containing recoverable metals is contacted with at least two electrodes, across which an electrical potential is applied to cause the metals to deposit upon said electrodes. The invention is particularly useful for the recovery of iron, zinc, lead, and manganese from a brine from a geothermal aquifer such as is found at the Salton Sea in California.

17 Claims, No Drawings

RECOVERY OF METALLIC COMPOUNDS FROM GEOTHERMAL BRINE

FIELD OF THE INVENTION

The invention relates to the treatment of a geothermal brine containing various dissolved components such as iron, zinc, manganese, and lead for the enhanced recovery of one or more of these components. More particularly, the invention relates to a method wherein such a brine is treated by electrolysis to deposit such components on an electrode.

BACKGROUND OF THE INVENTION

The solubility of most ions in solution decreases with a decrease in the temperature or pressure of the solution. If dissolved ions are present, near their saturation concentration in the solution, a slight reduction in the temperature or pressure can result in precipitation of a portion of these ions. The ions frequently combine and deposit as a scale on any solid surface with which they come into contact, such as a vessel or conduit in which the solution is confined. An example of such a solution is a geothermal brine.

Geothermal brines are used, among other things, for the generation of electric power. Typically, a geothermal brine, having a temperature above about 400° F., is flashed to a lower pressure in one or more flashing stages to produce steam and a spent brine. The steam is used to drive a steam turbine-electric generator combination. The spent brine is filtered and returned to the geothermal aquifer via a dedicated brine injection well. Typically, the steam is condensed and placed in a holding pond until a sufficient quantity is accumulated for reinjection into a dedicated condensate injection well. The amount of brine requiring reinjection is typically in excess of about 6000 gallons per minute. The amount of steam condensate produced, which also requires disposal, amounts to about 200 gallons per minute. Formidable problems are encountered in handling and disposing of such large amounts of heavily contaminated and highly saline geothermal liquids.

One of the more serious problems, encountered in using a geothermal brine for producing electric power, results from scaling and deposition of solids in the equipment used to confine the brine. A typical geothermal brine has been confined in a subterranean reservoir for an extraordinarily long period of time at elevated temperatures. As a result, large amounts of minerals have been leached from the reservoir into the brine. Typically, salts and oxides of heavy metals such as lead, zinc, iron, silver, cadmium, molybdenum, manganese and even gold are found in geothermal brines. Other more common minerals, such as calcium and sodium, also are dissolved in the brine, as are naturally occurring gases, including carbon dioxide, hydrogen sulfide and methane. An especially troublesome component of the brine is silica.

All of these components tend to precipitate out at almost every stage of brine processing. Even when the brine has completed its passage through a plant, it will contain a sufficient concentration of these components to eventually result in plugging of the injection wells used to return the brine and condensate to the geothermal aquifer.

Obviously, it would be beneficial if the more valuable base metals such as iron, zinc, manganese, and lead could be recovered. It would be even a greater benefit if a method for recovery of such metals could be controlled to enhance recovery of selected metals.

SUMMARY OF THE INVENTION

The present invention provides for the recovery of at least one metal from a geothermal brine containing the same. It also provides a method for enhancing the amount of one metal recovered with respect to others contained in the geothermal brine.

In accordance with the present invention, the geothermal brine containing metals and scale-forming constituents dissolved or suspended therein is subjected to electrolysis to recover the metal substantially free of the scale-forming constituents. Typically, the geothermal brine contains at least one metal selected from the group consisting of iron, zinc, lead, and manganese. Frequently, the geothermal brine will contain all such metals in varying concentrations. In addition, geothermal brines typically contain trace concentrations of silver, gold, and platinum. Geothermal brines also include various scale-forming constituents. The more common and troublesome scale-forming constituents comprise compounds of silica and barium which frequently precipitate in the form of sulfates. It is an advantage of the present invention that the metals are recovered substantially free of such scale-forming constituents.

Broadly, the invention comprises placing two spaced-apart electrodes in a geothermal brine. A potential is applied across the two electrodes to induce a current to flow from one electrode through the geothermal brine to the other electrode for a time sufficient for a deposit of metal to build up upon one of the electrodes. Thereafter, the deposit-coated electrode is removed from the geothermal brine for recovery of the metal therefrom. The relative amounts of metal deposited upon the electrode will vary depending on their relative concentration in the brine and the selection of electrode material, among other things. Also, the form in which the metal is deposited on the electrode will vary depending upon the various types of other constituents contained within the brine. Typically, the metals are deposited as the element, oxides, carbonates, and oxychlorides.

The potential applied to the electrodes may vary from as little as 0.2 volts to as high as 3 volts. Typically, the potential is maintained within the range from about 0.5 to 1.5 volts with a potential of from about 0.7 to 1.2 volts being particularly preferred. The time required to achieve a desired amount of metal deposition will vary depending upon the spacing between the electrodes, concentration of metals present, and applied voltage. Generally, a time from 8 to 48 hours is utilized, with a time from 12 to 24 hours being preferred.

It is a unique advantage of the present invention that the scale-forming constituents of brine such as silica, sodium, barium and sulfur remain in the brine. Thus, the metal recovered has a substantially greater value than it would have if those constituents were intermingled with it.

DETAILED DESCRIPTION OF THE INVENTION

For convenience, the invention will now be described with respect to its most preferred application, the recovery of metals from a waste geothermal brine stream containing the same. For a better understanding of the invention, a brief description of a typical geothermal brine process is provided.

Geothermal brine is withdrawn from a production well which extends down into a geothermal aquifer. The brine temperature will vary considerably from well to well, but is usually in the broad range of from 350° to 600° F., with a brine temperature of between about 450° to 500° F. being typical. The brine is introduced into a wellhead separator in which noncondensable gases are separated from the brine.

From the wellhead separator, the brine is introduced into one or more flashing vessels. Within each flashing vessel, the brine is flashed to a substantially lower pressure. As an example, the brine may be flashed from an initial pressure of about 450 psig to a lower pressure of about 50 psig. The abrupt reduction in pressure produces steam and what is referred to as rejected brine. The steam is passed to a steam turbine-generator to produce electric power. The steam from the turbine is passed to a condenser and cooling tower. A steam condensate, generally at a pH of about 8 to 10, is subsequently discharged into a holding pond where it is exposed to air to convert any sulfites and sulfides contained therein to sulfates. The sulfites and sulfides tend to react with metals forming a troublesome scale. The metal sulfide scales are particularly difficult to remove. A portion of the condensate is withdrawn for use as process water in the plant operations. All the condensate ultimately is injected into a dedicated condensate injection well.

Rejected brine from the flash vessels is treated to remove suspended solids contained therein. Typically, the brine is passed through one or more clarification vessels in which the solids are allowed to settle. In addition, the brine generally is filtered prior to its being injected into a dedicated brine injection well. Generally, the filtered brine will have a pH of about 5 to 6, a suspended solids concentration between about 5 and 20 parts per million and a total dissolved solids content of about 200,000 to 300,000 parts per million. For a more detailed description of a geothermal brine process, see U.S. Pat. No. 4,615,808, the disclosure of which is incorporated herein by reference.

The volumetric rate of brine requiring reinjection is substantial. A typical plant will produce about 6000 gallons of brine per minute. During the processing of brine at such large volumetric rates, a certain amount of spillage is common. Such spillage, generally referred to as brine slop, is drained into the holding pond where it mixes with the steam condensate. In the holding pond, constituents of the brine and condensate react, producing insoluble metal carbonates, sulfides and sulfates.

In accordance with the present invention, the electrolysis of the brine preferably takes place following the clarifier but prior to the reinjection pumps. The reason for this is that, subsequent to clarification, the brine typically is at substantially ambient pressure and at a temperature less than its boiling point. This in turn, of course, greatly facilitates the introduction into, and removal of, electrodes from the brine for maintenance and removal of deposited metals. The electrolysis could be practiced at other upstream points. However, the fact that the geothermal brine is at an elevated pressure and temperature would substantially complicate such practice.

A key aspect of the present invention is the discovery that by utilizing certain electrode materials and applying a certain potential to those electrodes, it is possible to recover base metals from a geothermal brine containing the same substantially free of most of the scale-forming constituents. Thus, marketable concentrations of valuable base metals such as lead, zinc, iron, and manganese, along with lesser amounts of silver, gold, platinum, and palladium, are recoverable from the brine substantially free of many of the scale-forming constituents. Generally, the metals are present in the brine in relatively minor concentrations compared to such scale-forming constituents as calcium, silica, barium, and the like. Typically, the ratio of such scale-forming species to base metal is greater than 20:1.

The electrodes for use in accordance with the present invention are selected from the group consisting of graphite, steel, and stainless steels alloys. The steel may be any of the commercially available mild carbon steels. Exemplary stainless steel alloys include duplex stainless steels and Hastaloy C-276, based on current experimental uses.

It has been found that, through the selection of a combination of the materials for the electrodes and applied potential, it is possible to alter the weight ratio of one metal relative to the others. Generally, it is preferred that the anode comprise graphite and the cathode comprise either mild steel or a stainless steel alloy. The shape of the electrodes is not particularly critical, though it is preferred that they be substantially identical in size, rectangular in cross shape, and directly opposed to one another to provide for a substantially uniform current density from one electrode to another.

The concentration of metal recovered from the brine will vary from one geothermal brine source to another as well as from one well to another in a given brine source. The more valuable metals, such as silver, gold, palladium, and platinum, are present in the brines in very low concentrations, typically less than about 5 parts per million total. Naturally, the recovery efficiencies for these metals is quite low. Metals of interest, iron, magnesium, zinc, and lead, are recoverable in sufficient quantity to have a significant dollar value. In accordance with the present invention, it is possible to form an electrodeposit comprising at least 10 percent, generally 20 percent, and frequently in excess of 20 weight percent iron, calculated as the elemental metal. In a similar manner, the deposit will usually comprise in excess of 3, generally in excess of 5, and frequently in excess of 6, weight percent manganese, also calculated as the element. Lead may vary from as little as slightly in excess of 3 percent to a range of from 10 to 13 weight percent or higher. The amount of zinc present in the brine generally is substantially lower and thus the recovery of zinc, as a weight percent of the total deposit, also is substantially lower. Zinc is usually present in the deposited metal in a concentration from about 1 to 5 and more typically 2 to 4 weight percent.

A particular advantage of the present invention is the metals are recovered as carbonates and oxides, substantially free of sulfur (i.e., less than 1 wt. percent and generally less than 0.1 et. percent). This absences of sulfur makes the deposited metals more desirable for elemental metal recovery, since processing of the deposit does not result in a sulfur-containing waste stream. It is calculated that the ratio of the cost of electrical power to deposit the metal versus the value of the co-deposited metals is at least 1:4 and could be reduced to 1:6 or lower.

In the practice of the present invention, at least two electrodes are placed in the geothermal brine, an anode and a cathode. In some instances, it may be preferred to utilize a plurality of electrodes, for example, one anode between two opposing cathodes, or an alternating series of anodes and cathodes. A potential is applied across the two electrodes to cause metals contained in the geothermal brine to deposit on the cathode. The applied potential typically is adjusted to provide a current density between the anode and cathode of from 0.8 to 2.0 and preferably from 1 to 4 amperes per square foot. The potential applied may range from as low as about 0.2 volts up to as high as about 3 volts or higher. Generally, a potential in the range of about 0.5 to 1.5 volts is utilized. Particularly good results have been obtained utilizing a potential of about 0.7 to 1.2 volts. Typically, the brine will have a pH from 4.5 to 5.5. The advantages and practice of the present invention will be more readily understood with reference to the following example, which is meant to be illustrative and not limit the invention.

EXAMPLE

The following series of tests was conducted at a commercial geothermal unit located at the Salton Sea. Eight tests were conducted on a slipstream of overflow brine from a secondary clarifier having a pH of about 4.9. For each test, a voltage was applied across the electrodes at a value ranging from 0.1 to 1.0 volt. Three electrodes were employed in each test; an anode, a cathode, and a mild steel reference electrode. Each electrode was approximately 0.25 inch in diameter and 1.75 inches long. A slip stream of the secondary clarifier overflow brine was allowed to pass over the electrodes at a rate of approximately 4 gallons per minute. The brine temperature and pressure were approximately 220° F. and 100 psig, respectively. Each test was conducted for 24 hours. During the test period, the amperage flowing from one electrode to the other was monitored. In general, the amperage increased rapidly during the early stages of the test and then leveled off.

After 24 hours, each test was terminated and the electrodes retrieved for analysis. The scale collected on the electrode was scraped off. The scale was then washed to remove entrained brine, dried overnight in a forced air oven, and weighed prior to analysis. The cathode material for tests 1–4, 5, 6, 7, and 8 was carbon steel, 2205 stainless steel, Hastaloy C-276, graphite, and galvanized iron poultry wire, respectively. The anode material for tests 1–3 and 4–8 was carbon steel and graphite, respectively.

During testing, it was noted that the amount of scale recovered on the cathode correlated well with the current density (the potential applied across the electrodes). Further, it was observed that as the current density increases, lead recovery decreases, while calcium, manganese, and zinc deposition increases. The composition of a typical Salton Sea Geothermal Brine is given in Table I. The results of these tests are set forth in Tables II and III.

TABLE I

TYPICAL SALTON SEA BRINE COMPOSITION (PH ~5.5)

| Analyte | Range ppm | Typically Greater than ppm |
|---|---|---|
| Ag | 1–2 | 1 |
| AS | 10–16 | 12 |
| B | 300–375 | 300 |
| Ba | 190–220 | 200 |
| C | 22,700–26,600 | 23,000 |
| Cu | 2–4 | 2 |
| Fe | 700–1,000 | 800 |
| K | 12,300–14,000 | 13,000 |
| Li | 165–180 | 170 |
| Mg | 30–52 | 35 |
| Mn | 760–1,000 | 800 |
| Na | 49,900–51,000 | 50,000 |
| Pb | 70–80 | 75 |
| Rb | 51–70 | 55 |
| Sb | 0.1–1 | 0.1 |
| $SiO_2$ | 440–540 | 450 |
| Sr | 380–400 | 380 |
| Zn | 280–350 | 300 |
| Br | 85–100 | 90 |
| Cl | 128,400–150,000 | 130,000 |
| F | 16–25 | 17 |
| I | 9–19 | 10 |
| $SO_4$ | 30–105 | 30 |
| $CO_2$ | 250–1,000 | 300 |
| $H_2S$ | 5–20 | 7 |
| $NH_3$ | 375–450 | 400 |
| TDS | 200,000–230,000 | 200,000 |

TABLE II

ELECTRODEPOSITION PILOT TESTS
QUANTITATIVE ANALYSES-CATHODE SCALES (wt. %)

| Test No. | As | Ba | Ca | Cu | Fe | Mg | Mn | Na | Pb | Si | Zn | Ag ppm | Au ppm | Pd ppm | Pt ppm |
|---|---|---|---|---|---|---|---|---|---|---|---|---|---|---|---|
| 1 | Insufficient sample for analysis | | | | | | | | | | | | | | |
| 2 | 1.1 | 0.2 | 10.3 | 0.3 | 36 | 0.2 | 5.4 | 0.9 | 5.5 | 3.8 | 2.2 | 145 | 2.9 | <0.02 | <0.02 |
| 3 | 0.6 | 0.2 | 20 | 0.2 | 20.1 | 0.3 | 6.7 | 0.7 | 3.4 | 3.3 | 2 | 104 | 0.3 | <0.02 | <0.02 |
| 4 | 0.6 | 0.3 | 22.5 | 0.2 | 16.1 | 0.4 | 6.7 | 1 | 2.8 | 3.2 | 2.3 | 74 | 0.2 | <0.02 | <0.02 |
| 5 | 1.1 | 0.7 | 19.3 | 0.6 | 19.2 | 0.2 | 3.8 | 2.9 | 10.5 | 5 | 1.8 | 460 | 2 | <0.02 | <0.1 |
| 6 | 1.5 | 0.8 | 6.8 | 0.8 | 26.8 | 0.3 | 5.6 | 0.4 | 12.7 | 4.6 | 3.1 | 430 | 0.1 | <0.02 | 0.7 |
| 7 | 0.6 | 0.4 | 8.2 | 0.7 | 17.6 | 0.1 | 3.5 | 3.5 | 11.7 | 3.9 | 1.3 | 340 | <0.1 | <0.02 | <0.02 |
| 8 | <0.1 | 0.1 | 24.9 | <0.1 | 4.6 | 0.2 | 1.7 | 5.9 | 1.2 | 0.9 | 0.7 | 181 | <0.1 | <0.02 | <0.02 |

TABLE III

ELECTRODEPOSITION PILOT TESTS
CALCULATED COMPOSITIONS-CATHODE SCALES (wt. %)

| Test No. | As203 | BaSO4 | Ca(OH)2 | CuOCl | Fe203 | MgO | Mn203 | NaCl | PbOCl | SiO2 | ZnO | Total |
|---|---|---|---|---|---|---|---|---|---|---|---|---|
| 2 | 1.5 | 0.3 | 19 | 0.5 | 49.7 | 0.3 | 7.8 | 2.3 | 6.9 | 8.1 | 2.7 | 99.1 |
| 3 | 0.8 | 0.3 | 37 | 0.4 | 27.7 | 0.5 | 9.6 | 1.8 | 4.2 | 7.1 | 2.5 | 91.9 |
| 4 | 0.8 | 0.5 | 41.6 | 0.4 | 22.2 | 0.7 | 9.6 | 2.5 | 3.5 | 6.8 | 2.9 | 91.5 |
| 5 | 1.5 | 1.2 | 35.7 | 1.1 | 26.5 | 0.3 | 5.5 | 7.4 | 13.1 | 10.7 | 2.2 | 105.2 |
| 6 | 2 | 1.4 | 12.6 | 1.4 | 37 | 0.5 | 8.1 | 1 | 15.9 | 9.8 | 3.8 | 93.5 |
| 7 | 0.8 | 0.7 | 15.2 | 1.3 | 24.3 | 0.2 | 5 | 9 | 14.6 | 8.3 | 1.6 | 81 |

TABLE III-continued

| ELECTRODEPOSITION PILOT TESTS CALCULATED COMPOSITIONS-CATHODE SCALES (wt. %) | | | | | | | | | | | | |
|---|---|---|---|---|---|---|---|---|---|---|---|---|
| Test No. | As203 | BaSO4 | Ca(OH)2 | CuOCl | Fe203 | MgO | Mn203 | NaCl | PbOCl | SiO2 | ZnO | Total |
| 8 | — | 0.2 | 46 | — | 6.3 | 0.3 | 2.4 | 15 | 1.5 | 1.9 | 0.9 | 74.5 |

From the Tables II and III, it will be seen in Test 1 where no potential is applied that only a trace of scale was deposited on the cathode. While an insufficient sample was obtained for analysis, prior experience with mild carbon steel exposed to a brine would suggest that the scale consisted primarily of silica, a copper-arsenic alloy, and barium sulfate. In Tests 2–8, with potentials ranging from 0.5 to 1.0 applied across the electrodes, a measurable amount of scale was recovered on the cathodes. Test 8 collected the least scale, while Test 4 collected the most. Compared to Test 1, electrolysis increased the amount of deposition by factors ranging from 3.5 to 45.

The compounds listed in Table III are the result of theoretical calculations. The rational for selecting the composition of the compounds set forth in Table III are based on (1) previous experience as to the crystalline forms of the components found in Salton Sea brines and (2) results of x-ray diffraction studies of such brines.

The cathode scales consisted primarily of ferric hydroxide and calcium hydroxide. Additionally, however, hydroxides and hydroxychlorides of significant quantities of lead, manganese, and zinc were recovered in these deposits together with some elemental lead. An attempt to increase the cathode surface area by using coiled wire to improve metal recovery in Test 8 was unsuccessful. Due to the high concentration of calcium in the brine (greater than 20,000 parts per million), it is not surprising that the calcium hydroxide would precipitate, based on mass action principles alone. Although the order of base metal levels in the Salton Sea geothermal brine is manganese (900 parts per million), zinc (350 parts per million), and lead (70 parts per million), the metal recovery does not always follow this order. Lead is often found to be the predominant heavy metal recovered at the cathode due to its ease of reduction from the plumbous ion to the element. The order of redox potentials for these metals being reduced from the divalent to the zero valent state is lead>>zinc>manganese. The poor recovery of precious metals, such as silver, gold, palladium, and platinum, is presumably due to their low concentration and possibly interference by reduction of the other heavy metals.

It is believed the foregoing example establishes conclusively that the present invention permits the recovery of base metals such as iron, lead, zinc, and manganese in economic quantities. Further, the results show that these metals are recovered substantially free of impurities such as sulfur, silica, and barium contaminants. In addition, the foregoing example shows that it is possible through the selection of electrode materials to alter the recovery of certain of the base metals relative to the others.

While a particular preferred embodiment of the invention has been described, it will be understood that the invention is not limited thereto since many modifications can be made. The invention may be practiced as either a continuous or a batch method. In addition, the applied voltages and resulting current densities may be varied to promote deposition of different proportions of the various metals. While certain materials have been taught for use as the electrode, it is also within the scope of the invention to utilize other materials which will enhance the deposition of desired base metals. It is intended to include within the scope of this invention all such modifications as will fall within the spirit and scope of the appended claims.

What is claimed is:

1. A method of depositing compounds containing at least one metal from a geothermal brine comprising:

contacting a geothermal brine containing dissolved metal components of at least one metal selected from the group consisting of iron, zinc, manganese, and lead and at least one scale-forming species with two spaced-apart electrodes, said electrodes made from material selected from the group consisting of mild steel, galvanized poultry wire, stainless steel, Hastalloy C-276, and graphite;

applying an electrical current having a potential voltage of between 0.2 and 3 volts across said electrodes to form a deposit containing at least one compound of said metal and at least some of said scale-forming species, said deposit containing a substantially larger proportion of said metal relative to the scale-forming species than the concentrations of the metal compared to the scale-forming species in the geothermal brine on the cathode; and recovering said deposit from said cathode.

2. The method of claim 1 wherein the pH of said brine is within the range of from about 4.5 to 7.5.

3. The method of claim 1 wherein said deposit comprises iron, zinc, lead, and manganese.

4. The method of claim 1 wherein said geothermal brine is derived from a Salton Sea Squifer.

5. The method of claim 2 wherein said applied voltage is within the range of about 0.5 to 1.5 volts.

6. A method of depositing compounds containing at least one metal from a geothermal brine containing metal components of said metal and scale-forming species comprising:

contacting a geothermal brine containing metal components of at least one metal selected from the group consisting of iron, zinc, lead, and manganese, and at least one scale-forming species selected from the group consisting of silica and barium compounds with at least two spaced-apart electrodes, said electrodes made from a material selected from the group consisting of mild steel, galvanized poultry wire, stainless steel, Hastalloy C-276, and graphite;

applying an electrical current having an electrical potential of between 0.2 and 3 volts across said electrodes to form a deposit on the cathode of at least one metal compound of said metal and at least some of said scale-forming species, said deposit containing a substantially larger proportion of metal relative to the scale-forming species than the concentrations of the metal to the scale-forming species in the geothermal brine; and recovering said deposit from said cathode.

7. The method of claim 5 wherein the pH of said brine is within the range of from about 4.5 to 5.5.

8. The method of claim 7 wherein said deposit comprises iron, zinc, lead, and manganese.

9. The method of claim 6 wherein said brine is a Salton Sea geothermal brine.

10. The method of claim 7 wherein one of said electrodes is graphite and the other is selected from the group consisting of steel and stainless steel alloys.

11. The method of claim 10 wherein said graphite electrode is an anode.

12. The method of claim 11 wherein said potential is within the range of from about 0.5 to 1.5 volts.

13. A method of treating a geothermal brine to recover metal constituents therefrom comprising:

contacting at least one cathode and one anode, said cathode and anode made from a material selected from the group consisting of mild steel, galvanized poultry wire, stainless steel, Hastalloy C-276, and graphite, with a geothermal brine containing (1) metal components selected from the group consisting of iron, zinc, lead, and manganese, and (2) scale-forming species comprising silica and barium compounds;

applying an electrical current having a voltage potential of from 0.7 to 1.2 volts for a time of at least 8 hours to form a deposit comprising at least one compound of at least one of said metals and at least some of said scale-forming species, said deposit containing a substantially larger proportion of metal relative to the scale-forming species than the concentrations of the metal to the scale-forming species in the geothermal brine on the cathode; and recovering said deposit from said cathode.

14. The method of claim 13 wherein the brine also contains sulfur species and said deposit is substantially free of said sulfur species.

15. The method of claim 11 wherein the metal constituents of said deposit comprise a major amount of iron and a minor amount of zinc, lead, and manganese.

16. The method of claim 14 wherein said brine has a pH in the range of about 4.5 to 5.5.

17. The method of claim 15 wherein said anode comprises graphite and said cathode comprises a material selected from the group consisting of mild carbon steel and stainless steel alloys.

* * * * *

UNITED STATES PATENT AND TRADEMARK OFFICE

CERTIFICATE OF CORRECTION

PATENT NO. : 5,254,225

DATED : October 19, 1993

INVENTOR(S) : Darrell L. Gallup

It is certified that error appears in the above-identified patent and that said Letters Patent is hereby corrected as shown below:

Claim 1, column 8, line 24, after "from" insert -- a --.

Claim 4, column 8, line 42, replace "Squifer" with -- aquifer --.

Claim 5, column 8, line 43, replace "2" with -- 3 --.

Signed and Sealed this

Third Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,254,225

DATED : October 19, 1993

INVENTOR(S) : Darrell L. Gallup

It is certified that error appears in the above-identified patent and that said Letters Patent is hereby corrected as shown below:

Claim 7, column 9, line 1, replace "5" with -- 6 --.

Claim 15, column 10, line 16, replace "11" with -- 13 --.

Signed and Sealed this

Fourteenth Day of June, 1994

Bruce Lehman

*Attest:*

BRUCE LEHMAN

*Attesting Officer*

*Commissioner of Patents and Trademarks*